US010745873B2

(12) United States Patent
Kamimae et al.

(10) Patent No.: US 10,745,873 B2
(45) Date of Patent: Aug. 18, 2020

(54) WORK VEHICLE

(71) Applicant: KOMATSU LTD., Tokyo (JP)

(72) Inventors: Takeshi Kamimae, Tokyo (JP); Nobuo Matsuyama, Tokyo (JP); Shintaro Kobayashi, Tokyo (JP); Muneo Harada, Tokyo (JP)

(73) Assignee: KOMATSU LTD., Tokyo (JP)

( * ) Notice: Subject to any disclaimer, the term of this patent is extended or adjusted under 35 U.S.C. 154(b) by 196 days.

(21) Appl. No.: 15/819,018

(22) Filed: Nov. 21, 2017

(65) Prior Publication Data

US 2018/0355569 A1 Dec. 13, 2018

(30) Foreign Application Priority Data

Jun. 9, 2017 (JP) ..... 2017-114418

(51) Int. Cl.
*E01H 5/06* (2006.01)

(52) U.S. Cl.
CPC ..... *E01H 5/066* (2013.01); *E01H 5/061* (2013.01)

(58) Field of Classification Search
CPC ..... E01H 5/066; E01H 5/061
See application file for complete search history.

(56) References Cited

U.S. PATENT DOCUMENTS 3,061,955 A * 11/1962 Violette ..... E02F 3/815 172/815
3,148,466 A * 9/1964 Batko ..... E02F 3/7659 172/781
3,231,991 A * 2/1966 Wandscheer ..... E01H 5/063 37/280
3,605,167 A * 9/1971 Martel ..... A01K 1/0128 15/236.05
4,077,139 A * 3/1978 Fagervold ..... E01H 5/067 172/784
4,575,278 A * 3/1986 Whitney ..... E01C 11/224 404/14
4,614,048 A * 9/1986 Melby ..... E01H 5/065 172/815
4,701,069 A * 10/1987 Whitney ..... E01C 11/224 404/75
5,203,923 A * 4/1993 Hartman ..... B05B 9/06 118/323

(Continued)

FOREIGN PATENT DOCUMENTS

JP H05-287715 A 11/1993

*Primary Examiner* — Jamie L McGowan
(74) *Attorney, Agent, or Firm* — Faegre Drinker Biddle & Reath LLP

(57) ABSTRACT

A work vehicle allowing a simplified operation to open and close a shutter in a simple configuration is provided. The shutter can be disposed alternatively at a first position at which the shutter protrudes forward from a lower end of a blade or at a second position at which the shutter is farther away from the lower end than at the first position. The controller is configured to receive an input of an operation instruction from an input operation unit for moving the shutter from the second position to the first position, to cause the shutter to move from the second position to the first position. After a lapse of a prescribed time period since the shutter is moved to the first position, the controller causes the shutter to move from the first position to the second position.

12 Claims, 9 Drawing Sheets

(56) References Cited

U.S. PATENT DOCUMENTS

| | | | | |
|---|---|---|---|---|
| 6,523,620 | B1 * | 2/2003 | Burson | E01H 5/066<br>172/815 |
| 6,547,484 | B2 * | 4/2003 | Murphy | E01C 23/0993<br>299/39.6 |
| 7,051,819 | B1 * | 5/2006 | Schenk | E01H 1/003<br>172/782 |
| RE40,505 | E * | 9/2008 | Murphy | E01C 23/0993<br>299/39.6 |
| 7,918,042 | B2 * | 4/2011 | Ropog | E01H 5/066<br>37/281 |
| 8,127,472 | B2 * | 3/2012 | Kotila | E01H 5/066<br>37/281 |
| 9,085,859 | B2 * | 7/2015 | Andic | E01H 5/06 |
| 10,113,283 | B1 * | 10/2018 | Jones | E01H 5/066 |

* cited by examiner

WORK VEHICLE

This nonprovisional application is based on Japanese Patent Application No. 2017-114418 filed on Jun. 9, 2017 with the Japan Patent Office, the entire contents of which are hereby incorporated by reference.

BACKGROUND OF THE INVENTION

Field of the Invention

The present invention relates to a work vehicle.

Description of the Background Art

Conventionally, there has been a proposed technique related to a vehicle configured to perform snow removal work and including a blade equipped with a shutter arranged so as to be freely raised and lowered, the technique being intended to open and close the shutter by operating a switch, or intended to open and close the shutter when a marker placed on a road is detected (for example, see Japanese Patent Laying-Open No. 05-287715).

SUMMARY OF THE INVENTION

When snow removal work is performed by a motor grader having a blade, a windrow is formed on the side part of the motor grader so as to extend in a ridge shape in the traveling direction of the motor grader. Thus, when the motor grader travels through areas where traffic is obstructed if a windrow is formed thereon, such as an intersection or an entrance of a public facility, the shutter is closed so as to temporarily prevent formation of a windrow.

For operating the motor grader, a large number of operation devices such as a lever need to be operated as appropriate. Accordingly, it is troublesome for the operator who is aboard the motor grader performing snow removal work to manually perform an operation to open and close the shutter. Although the above-described literature proposes the technique for automatically opening and closing a shutter by detecting a marker placed on a road, it is necessary to place markers on both sides of every intersection in order to automatically open and close the shutter, which is difficult to be realized.

An object of the present invention is to provide a work vehicle allowing a simplified operation to open and close a shutter in a simple configuration.

A work vehicle according to an aspect of the present invention includes a blade, a shutter, an actuator, an input operation unit, and a controller. The blade includes a lower end. The shutter is attached to the blade. The shutter can be disposed alternatively at a first position at which the shutter protrudes forward from the lower end of the blade or at a second position at which the shutter is farther away from the lower end than at the first position. The actuator is configured to cause the shutter to move from one to the other between the first position and the second position. The input operation unit is configured to input an operation instruction to the actuator. The controller is configured to receive an input of the operation instruction from the input operation unit to move the shutter from the second position to the first position, to cause the shutter to move from the second position to the first position. After a lapse of a prescribed time period since the shutter is moved to the first position, the controller causes the shutter to move from the first position to the second position.

A work vehicle according to an aspect of the present invention includes a blade, a shutter, an actuator, an input operation unit, a sensor, and a controller. The blade includes a lower end. The shutter is attached to the blade. The shutter can be disposed alternatively at a first position at which the shutter protrudes forward from the lower end of the blade or at a second position at which the shutter is farther away from the lower end than at the first position. The actuator is configured to cause the shutter to move from one to the other between the first position and the second position. The input operation unit is configured to input an operation instruction to the actuator. The sensor is configured to detect a traveling distance of the work vehicle after the shutter is moved to the first position. The controller is configured to receive an input of the operation instruction from the input operation unit to move the shutter from the second position to the first position, to cause the shutter to move from the second position to the first position. After the work vehicle travels for a prescribed distance since the shutter is moved to the first position, the controller causes the shutter to move from the first position to the second position.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
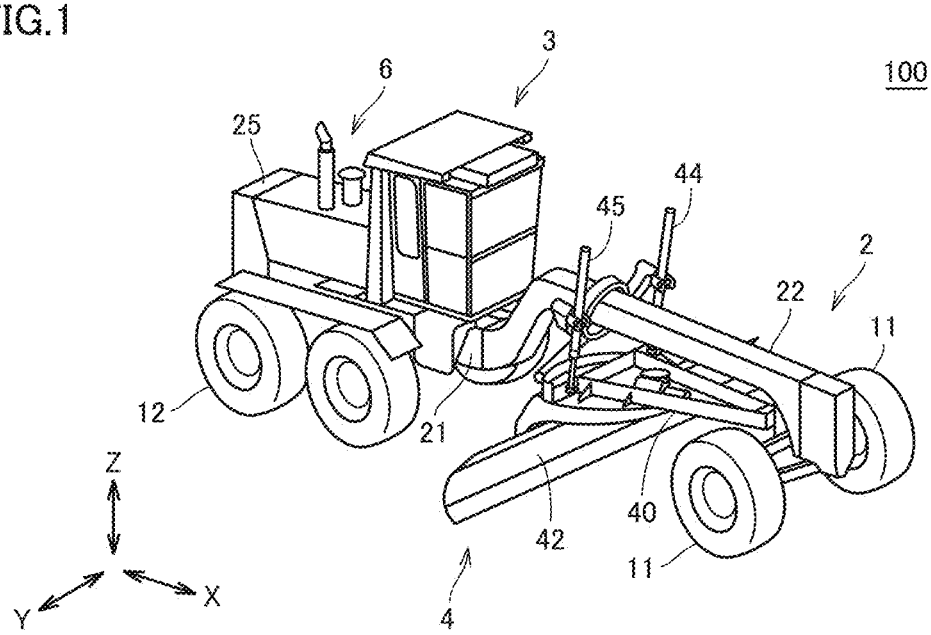
FIG. 1 is a perspective view schematically showing the configuration of a work vehicle according to an embodiment.

The embodiments will be hereinafter described with reference to the accompanying drawings. In the following description, the same components are designated by the same reference characters. Names and functions thereof are also the same. Accordingly, the detailed description thereof will not be repeated.

Figure 2:
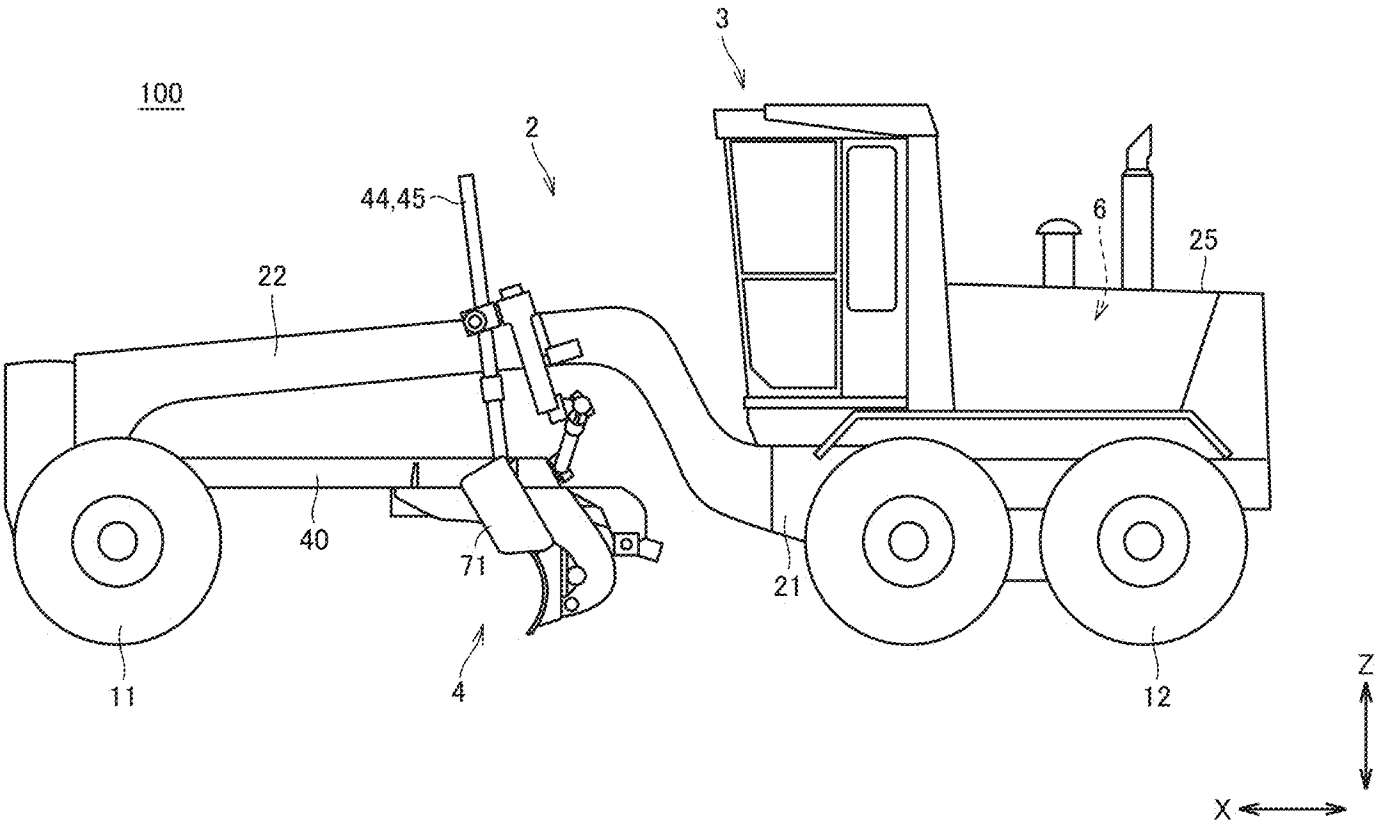
FIG. 2 is a side view schematically showing the configuration of the work vehicle according to an embodiment.

FIG. 1 is a perspective view schematically showing the configuration of a work vehicle 100 according to an embodiment. FIG. 2 is a side view schematically showing the configuration of work vehicle 100 according to an embodiment. In the present embodiment, a motor grader will be described as an example of work vehicle 100.

As shown in FIGS. 1 and 2, work vehicle 100 according to an embodiment mainly includes a front wheel 11 serving as a driving wheel, a rear wheel 12 serving as a driving wheel, a vehicular body frame 2, an operator's cab 3, and a work implement 4. Furthermore, work vehicle 100 includes components such as an engine disposed in an engine compartment 6. Work implement 4 includes a blade 42. Work vehicle 100 travels in the state where blade 42 is brought into contact with the road surface or the state where there is a slight gap between blade 42 and the road surface. Thereby, snow removal work can be carried out by blade 42.

FIGS. 1 and 2 each show a total of six driving wheels including two front wheels 11 (one on each side) and four rear wheels 12 (two on each side), but the number and the arrangement of the front wheels and the rear wheels are not limited to the examples shown in FIGS. 1 and 2.

In the following description of the figures, the direction in which work vehicle 100 travels straight forward is referred to as a front-rear direction of work vehicle 100. In the front-rear direction of work vehicle 100, the direction toward the side on which front wheel 11 is disposed with respect to work implement 4 is referred to as a frontward direction. In the front-rear direction of work vehicle 100, the direction toward the side on which rear wheel 12 is disposed with respect to work implement 4 is referred to as a rearward direction. The right-left direction of work vehicle 100 is the direction orthogonal to the front-rear direction as seen in plan view. From the viewpoint in the frontward direction, the right side and the left side in the right-left direction are respectively the rightward direction and the leftward direction. The top-bottom direction of work vehicle 100 is the direction orthogonal to a plane defined by the front-rear direction and the right-left direction. In the top-bottom direction, the ground side is the lower side and the sky side is the upper side.

The front-rear direction is the front-rear direction with respect to an operator sitting on the operator's seat in operator's cab 3. The right-left direction is the right-left direction with respect to an operator sitting on the operator's seat. The right-left direction is the vehicular width direction of work vehicle 100. The top-bottom direction is the top-bottom direction with respect to an operator sitting on the operator's seat. The direction in which an operator sitting on the operator's seat faces is the frontward direction, and the backward direction with respect to an operator sitting on the operator's seat is the rearward direction. The right side and the left side with respect to an operator sitting on the operator's seat and facing frontward are respectively the rightward direction and the leftward direction. The feet side and the head side of an operator sitting on the operator's seat are respectively the lower side and the upper side.

In the figures as described below, the front-rear direction is indicated by an arrow X, the right-left direction is indicated by an arrow Y, and the top-bottom direction is indicated by an arrow Z.

Vehicular body frame 2 extends in the front-rear direction (right-left direction in FIG. 2). Vehicular body frame 2 includes a rear frame 21 and a front frame 22.

Rear frame 21 supports an exterior cover 25 and components such as an engine disposed in engine compartment 6. The engine is mounted in rear frame 21. The engine is disposed behind operator's cab 3. Exterior cover 25 covers engine compartment 6. Exterior cover 25 defines engine compartment 6 housing the engine. For example, each of four rear wheels 12 described above is supported on rear frame 21 so as to be capable of being rotatably driven with the driving force from the engine.

Front frame 22 is attached frontward of rear frame 21. Front frame 22 is coupled to rear frame 21 so as to be pivotable. Front frame 22 extends in the front-rear direction. Front frame 22 includes a base end coupled to rear frame 21 and a leading end on the opposite side to the base end. The base end of front frame 22 is coupled to the leading end of rear frame 21 via a vertical center pin.

To the front end of front frame 22, for example, two front wheels 11 described above are attached so as to be rotatable. Work vehicle 100 may be configured in a rear-wheel drive system, or may be configured in an all-wheel drive system in which each of front wheels 11 and rear wheels 12 is rotatably driven with the driving force from the engine.

Front wheels 11 are attached to front frame 22 so as to be revolvable by extension and contraction of the steering cylinder (not shown). Work vehicle 100 can change its traveling direction by extension and contraction of the steering cylinder. The steering cylinder can be extended and contracted by operating the handle or the steering control lever provided inside operator's cab 3.

Operator's cab 3 has an interior space in which an operator is aboard, and is mounted at the front end portion of rear frame 21. Inside operator's cab 3, operation units such as a handle for a revolving operation, a shift lever, a control lever of work implement 4, a brake, an accelerator pedal, and an inching pedal are provided. Operator's cab 3 has a front portion, side portions on the right and left sides, and a rear portion. The space surrounded by the front portion, the side portions and the rear portion forms an interior space in operator's cab 3. In addition, operator's cab 3 may be mounted on front frame 22.

Work implement 4 mainly includes a drawbar 40, a blade 42, and a pair of lift cylinders 44 and 45.

The front end of drawbar 40 is attached to the leading end of front frame 22 so as to be swingable. The rear end of drawbar 40 is supported by the pair of lift cylinders 44 and 45 on front frame 22.

By extension and contraction of the pair of lift cylinders 44 and 45, the rear end of drawbar 40 can be vertically raised and lowered with respect to front frame 22. By contraction of both lift cylinders 44 and 45, the height of blade 42 relative to front frame 22 and front wheels 11 is adjusted in the upward direction. By extension of both lift cylinders 44 and 45, the height of blade 42 relative to front frame 22 and front wheels 11 is adjusted in the downward direction.

Furthermore, drawbar 40 is capable of swinging upward and downward about the axis along the vehicle traveling direction as lift cylinders 44 and 45 are differently extended and contracted.

Blade 42 is disposed between front wheels 11 and rear wheels 12. Blade 42 has a shape of a curved surface that is smoothly curved as seen from the side. Blade 42 has a front surface as a surface on the inside of the curve and a rear surface as a surface on the outside of the curve. The front surface of blade 42 has a shape of a curved surface that is curved in a concave shape. The rear surface of blade 42 has a shape of a curved surface that is curved in a convex shape.

Blade 42 is supported on drawbar 40. Blade 42 is supported on front frame 22 through drawbar 40.

As described above, blade 42 is configured such that it can be raised and lowered with respect to the vehicle via drawbar 40 and also can be swung about the axis along the vehicle traveling direction via drawbar 40.

A blade shutter apparatus 70 is attached to the left end of blade 42. Blade shutter apparatus 70 includes a shutter 71. Shutter 71 is configured such that it can be disposed alternatively at the first position at which shutter 71 protrudes forward from the lower end of blade 42 or at the second position at which shutter 71 is farther away from the lower end of blade 42 than at the first position. Shutter 71 shown in FIG. 2 is disposed at the second position. The details of blade shutter apparatus 70 will be described later.

Blade shutter apparatus 70 may be attached to the right end of blade 42. Blade shutter apparatus 70 may be attached to one of the left end and the right end of blade 42, or may be attached to both the left end and the right end of blade 42.

In addition to the configurations shown in FIGS. 1 and 2, work vehicle 100 may include a rough-surface forming apparatus configured to provide scratches in streak shape on the surface of the compacted-snow covered road so as to be roughened. The rough-surface forming apparatus may be disposed so as to protrude rearward from rear frame 21.

Figure 3:
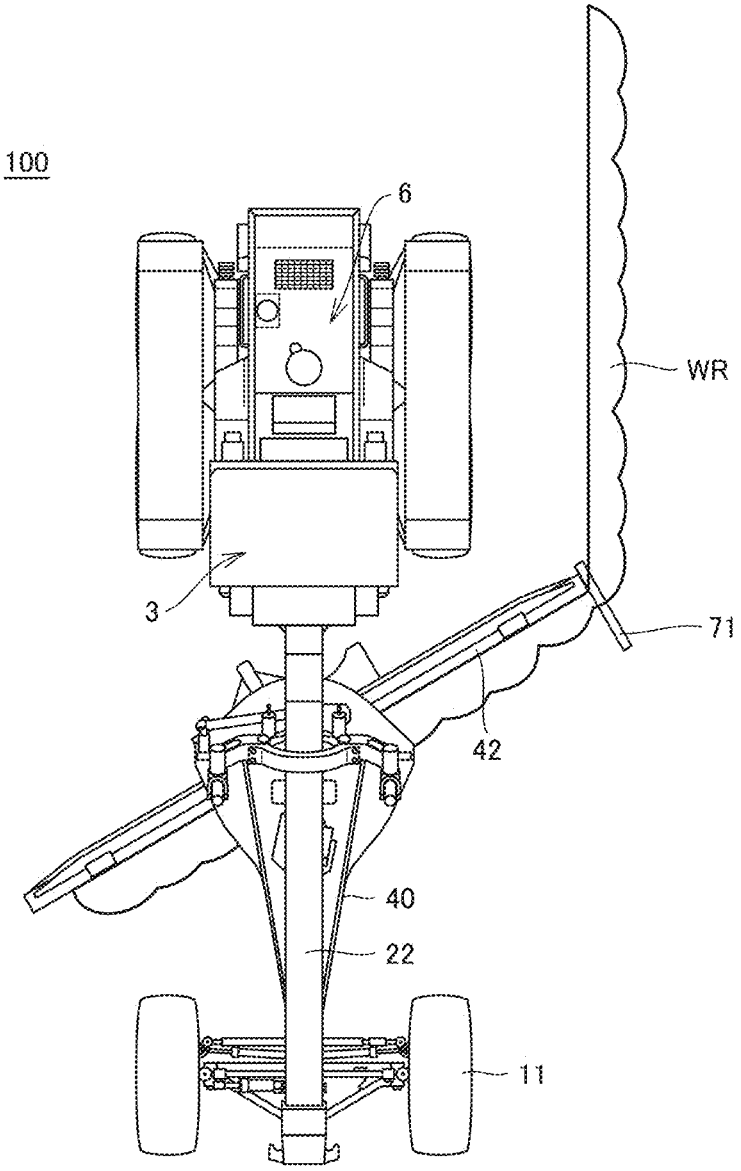
FIG. 3 is a top view showing snow removal work of the work vehicle according to an embodiment.

FIG. 3 is a top view showing snow removal work of work vehicle 100 according to an embodiment. When work vehicle 100 travels in the state where shutter 71 of blade shutter apparatus 70 is disposed at the second position, the snow removed from the road surface by blade 42 is accumulated as a windrow WR on the left side of work vehicle 100. The second position of shutter 71 may also be referred to as a windrow formation position at which windrow WR is formed on the side of work vehicle 100 during traveling of work vehicle 100.

Figure 4:
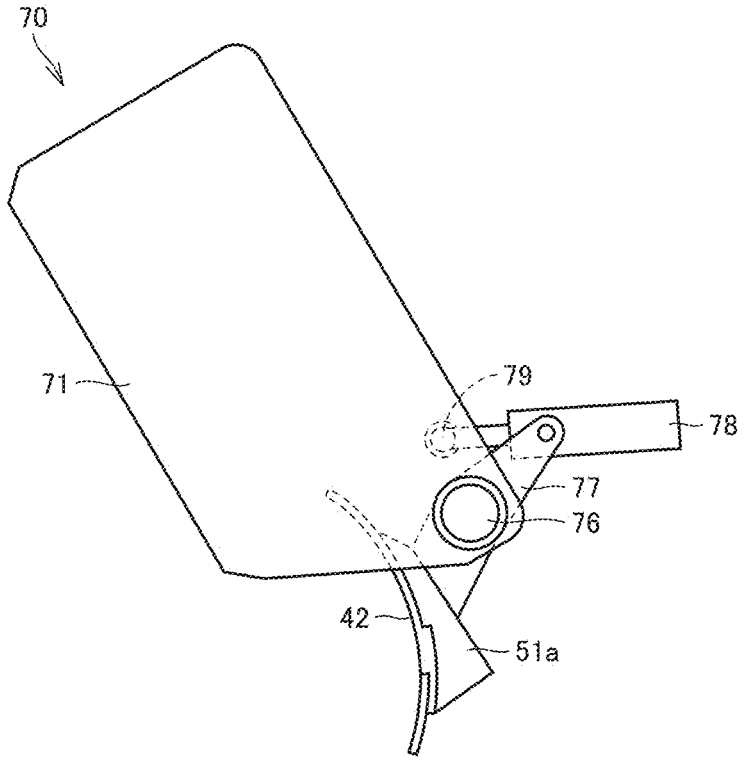
FIG. 4 is a side view showing the state where a shutter of a blade shutter apparatus is disposed at the second position.
Figure 5:
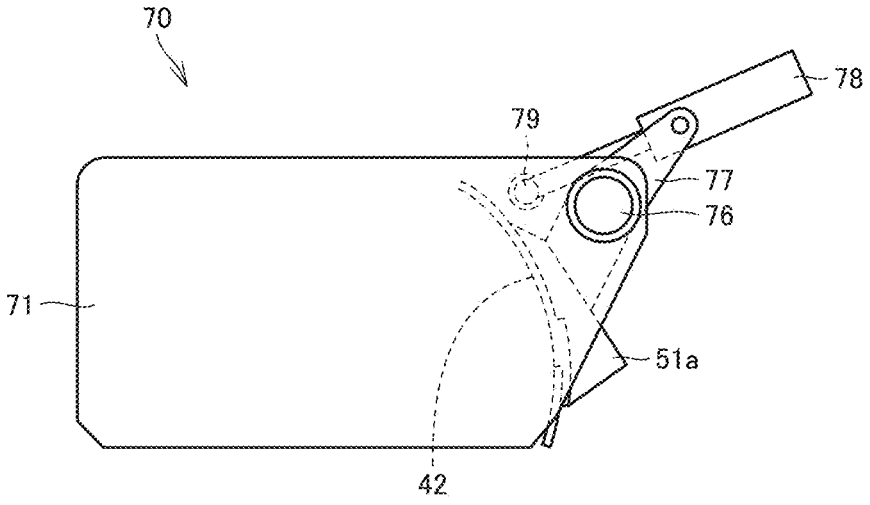
FIG. 5 is a side view showing the state where the shutter of the blade shutter apparatus is disposed at the first position.

FIG. 4 is a side view showing the state where shutter 71 of blade shutter apparatus 70 is disposed at the second position. FIG. 5 is a side view showing the state where shutter 71 of blade shutter apparatus 70 is disposed at the first position.

As shown in FIGS. 4 and 5, blade 42 has a support bracket 51*a*. Support bracket 51*a* is fixed to the rear surface of blade 42. A coupling bracket 77 is attached to support bracket 51*a*. A pivot shaft 76 is provided at coupling bracket 77. Shutter 71 is provided so as to be pivotable relative to support bracket 51*a* about pivot shaft 76. A cylinder 78 is coupled to coupling bracket 77.

Cylinder 78 includes a rod that has a tip end provided with a pin 79. Shutter 71 is coupled to cylinder 78 through pin 79. By extension and contraction of cylinder 78, shutter 71 is moved relative to blade 42. By contraction of cylinder 78, shutter 71 is raised and disposed at the second position shown in FIG. 4. By extension of cylinder 78, shutter 71 is lowered and disposed at the first position shown in FIG. 5.

Figure 6:
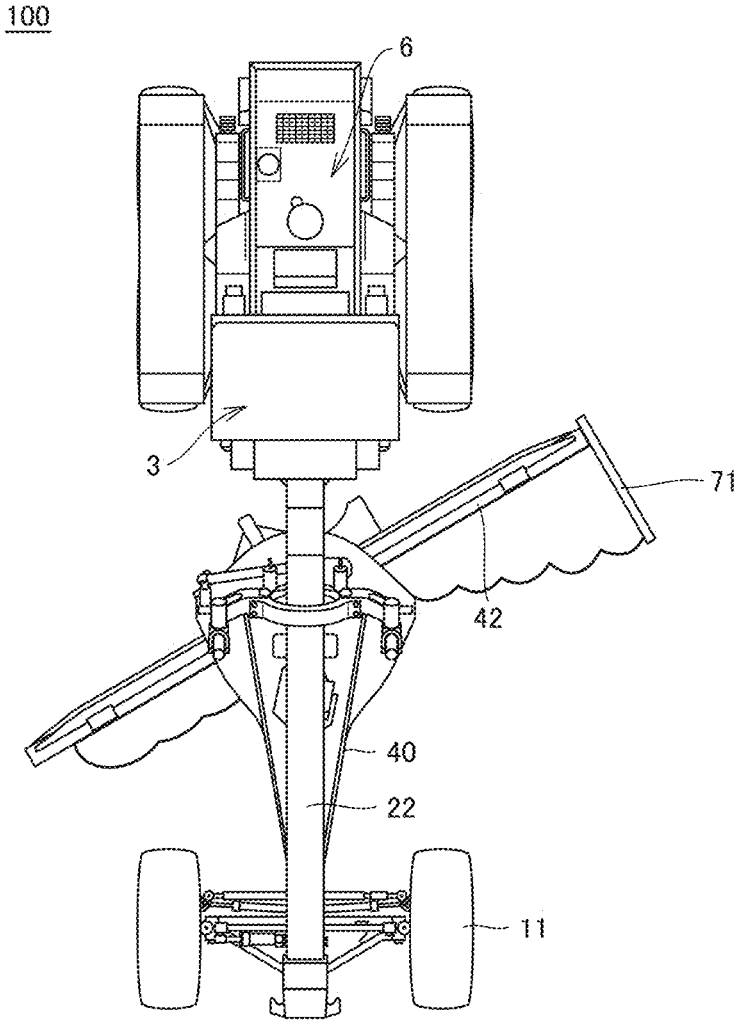
FIG. 6 is a top view showing snow removal work of the work vehicle in the state where the shutter is disposed at the first position.

FIG. 6 is a top view showing snow removal work of work vehicle 100 in the state where shutter 71 is disposed at the first position. In the state where shutter 71 of blade shutter apparatus 70 is disposed at the first position, even if work vehicle 100 travels, the snow removed from the road surface is accumulated by shutter 71 on the front surface of blade 42 but does not flow out in the lateral direction. Accordingly, no windrow is formed on the left side of work vehicle 100 as shown in FIG. 6. The first position of shutter 71 may also be referred to as a windrow non-formation position at which windrow WR is not formed on each side of work vehicle 100 during traveling of work vehicle 100.

Shutter 71 is disposed to face the end face of blade 42 in the right-left direction and protrude laterally from blade 42. As seen in the longitudinal direction of blade 42, shutter 71 disposed at the first position covers most of blade 42. As seen in the longitudinal direction of blade 42, shutter 71 disposed at the second position covers only a part of the vicinity of the upper end of blade 42. Blade 42 is laterally covered more by shutter 71 disposed at the first position than by shutter 71 disposed at the second position. Shutter 71 disposed at the second position does not cover the lower end of blade 42. When shutter 71 is disposed at the second position, the lower end of blade 42 is exposed laterally as shown in FIG. 4.

Shutter 71 is not necessarily disposed to face the end face of blade 42. For example, shutter 71 may be disposed so as to face the front surface of blade 42. In this case, shutter 71 disposed at the first position may be disposed such that most of this shutter 71 faces the front surface of blade 42, whereas shutter 71 disposed at the second position may be disposed such that most of this shutter 71 does not face the front surface of blade 42. In an arrangement where windrow WR is formed on the side of work vehicle 100 while work vehicle 100 is traveling in the state where shutter 71 is disposed at the second position, but windrow WR is not formed on the side of work vehicle 100 in the state where shutter 71 is disposed at the first position, an optional arrangement of shutter 71 and optional means for attaching shutter 71 to blade 42 may be selected as appropriate.

Figure 7:
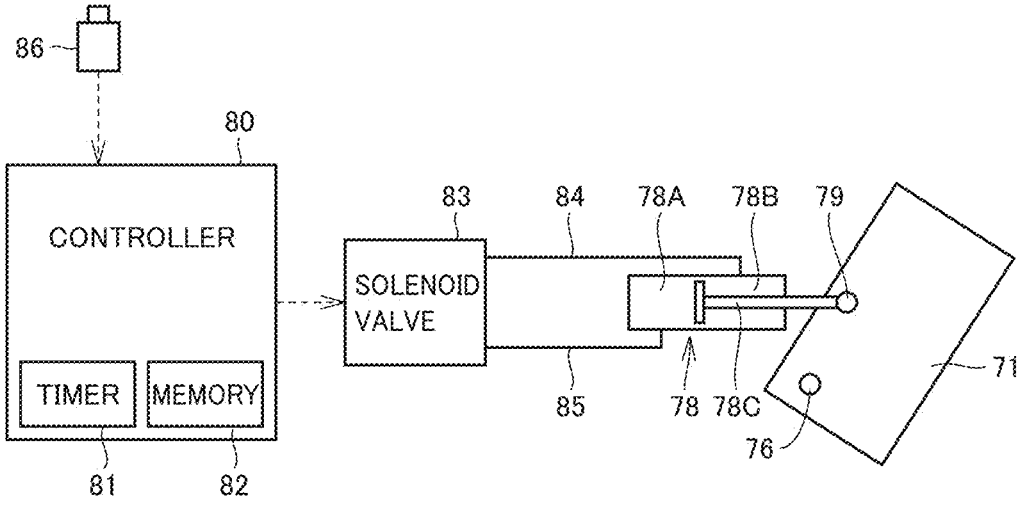
FIG. 7 is a diagram illustrating a functional block of the work vehicle according to an embodiment.

FIG. 7 is a diagram illustrating a functional block of work vehicle 100 according to an embodiment. As shown in FIG. 7, work vehicle 100 includes a controller 80 for controlling the operation of work vehicle 100. Controller 80 includes a timer 81 and a memory 82. Timer 81 measures time. Memory 82 is provided as a region storing a program for executing various operations in work vehicle 100 and also storing necessary data. Controller 80 performs various processes based on the program stored in memory 82.

Work vehicle 100 includes a solenoid valve 83. Solenoid valve 83 is disposed in an oil passage configured to couple a hydraulic pump (not shown) and cylinder 78. Oil passages 84 and 85 shown in FIG. 7 each are a part of the oil passage coupling the hydraulic pump and cylinder 78, and arranged between solenoid valve 83 and cylinder 78. Oil passages 84 and 85 each are located downstream of solenoid valve 83 in the direction in which oil flows from the hydraulic pump toward cylinder 78.

Solenoid valve 83 is controlled based on a control signal from controller 80. The hydraulic pressure supplied to cylinder 78 is adjusted by solenoid valve 83. Cylinder 78 includes a bottom-side oil chamber 78A and a head-side oil chamber 78B. Oil passage 84 is connected to head-side oil chamber 78B. Oil passage 85 is connected to bottom-side oil chamber 78A. Based on the control signal from controller 80, solenoid valve 83 can adjust the amount of oil supplied through oil passage 84 into head-side oil chamber 78B and the amount of oil supplied through oil passage 85 into bottom-side oil chamber 78A.

A rod 78C of cylinder 78 is moved by supplying the appropriate hydraulic pressure into bottom-side oil chamber 78A and head-side oil chamber 78B. Thereby, shutter 71 coupled to pin 79 at the end of rod 78C is rotated about pivot shaft 76 in either direction. Shutter 71 is moved in the direction in which shutter 71 becomes closer to the lower end of blade 42 from the second position toward the first position, or moved in the direction in which shutter 71 becomes farther away from the lower end of blade 42 from the first position toward the second position. Solenoid valve 83 and cylinder 78 constitute an actuator configured to move shutter 71 from one to the other between the first position and the second position.

Work vehicle 100 includes an input operation unit 86. Input operation unit 86 is disposed in operator's cab 3. The operator aboard operator's cab 3 inputs an operation instruction for solenoid valve 83 into input operation unit 86.

Input operation unit 86 receives an input of an operation instruction to extend cylinder 78 for lowering shutter 71 so as to be moved from the second position to the first position. In response to reception of this input, controller 80 transmits a control signal to solenoid valve 83 to supply oil into bottom-side oil chamber 78A through oil passage 85. Thereby, cylinder 78 is extended to cause shutter 71 to move from the second position to the first position.

Furthermore, input operation unit 86 is configured to be capable of receiving an input of an operation instruction to contract cylinder 78 for raising shutter 71 so as to be moved from the first position to the second position. In response to reception of this input, controller 80 transmits a control signal to solenoid valve 83 to supply oil into head-side oil chamber 78B through oil passage 84. Thereby, cylinder 78 is contracted to cause shutter 71 to move from the first position to the second position.

Input operation unit 86 in the embodiment has one push-button switch. Input operation unit 86 provided as a push-button switch is configured to be capable of alternatively performing one of a short press operation and a long press operation. The short press operation corresponds to the first operation in the embodiment. The long press operation corresponds to the second operation in the embodiment.

The short press operation is to continuously press a push-button switch for a time period relatively shorter than that in the long press operation. The long press operation is to continuously press a push-button switch for a time period relatively longer than that in the short press operation, and thus, is different from the short press operation. For example, the operation taking less than one second from when the push-button switch is pressed until when it is released may be defined as a short press operation; and the operation taking one second or more from when the push-button switch is pressed until when it is released may be defined as a long press operation.

Input operation unit 86 provided as a push-button switch is configured such that both the short press operation and the long press operation can be performed as an operation instruction to move shutter 71 from the second position to the first position.

In the case where controller 80 causes shutter 71 to move to the first position in response to reception of an input from input operation unit 86 having accepted the short press operation, when input operation unit 86 next receives an input of an operation instruction to move shutter 71 from the first position to the second position, controller 80 causes shutter 71 to move from the first position to the second position.

When controller 80 causes shutter 71 to move to the first position in response to reception of an input from input operation unit 86 having accepted the long press operation, controller 80 causes shutter 71 to move from the first position to the second position automatically after a lapse of a prescribed time period since shutter 71 is moved to the first position. Timer 81 measures the time elapsed since shutter 71 is moved to the first position. Movement of shutter 71 to the first position can be detected by a cylinder stroke sensor attached to cylinder 78, or can be detected by a proximity sensor for detecting shutter 71 itself disposed at the first position.

Input operation unit 86 is not limited to a push-button switch, but may have an optional configuration by which an operator can input an operation instruction to cylinder 78. Input operation unit 86 may have other types of switches such as a toggle switch or a rotary switch. Input operation unit 86 may have a touch panel.

Figure 8:
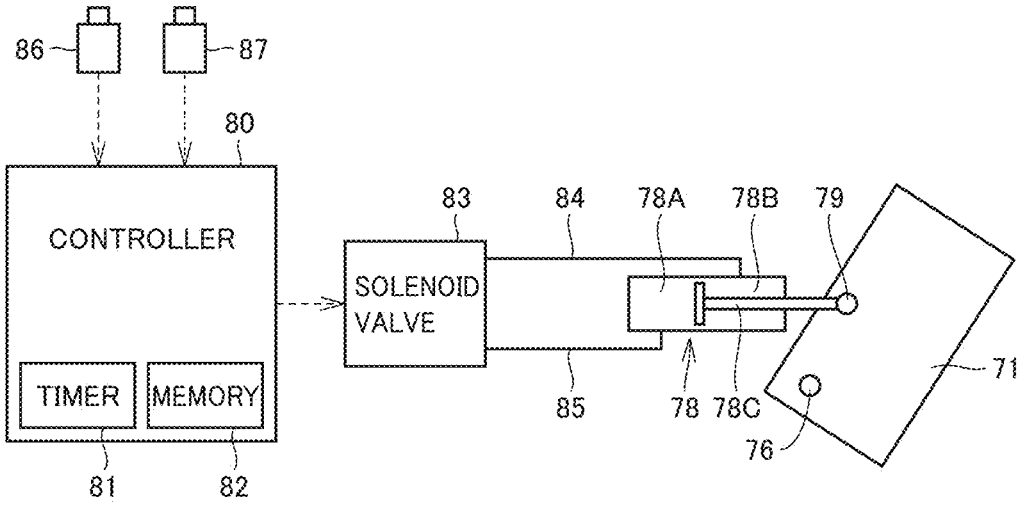
FIG. 8 is a diagram illustrating the first modification of the functional block of the work vehicle according to an embodiment.

FIG. 8 is a diagram illustrating the first modification of a functional block of work vehicle 100 according to an embodiment. The configuration shown in FIG. 8 is different from the configuration shown in FIG. 7 in that it further includes a second input operation unit 87. The configuration shown in FIG. 8 includes a plurality of input operation units each configured to input an operation instruction to an actuator. In the case of the configuration including a plurality of input operation units, input operation unit 86 and second input operation unit 87 can be configured to have different functions.

For example, input operation unit 86 may be used in order to input an operation instruction to move shutter 71 from the second position to the first position, and second input operation unit 87 may be used in order to input an operation instruction to move shutter 71 from the first position to the second position. In this case, depending on whether input operation unit 86 undergoes a short press operation or a long press operation, it may be determined whether movement of shutter 71 from the first position to the second position is executed automatically or by the operation of second input operation unit 87.

Also, in a configuration example, the operation instruction to move shutter 71 from the second position to the first position may be able to be input into both input operation unit 86 and second input operation unit 87. In this case, when the operation instruction to move shutter 71 from the second position to the first position is input into input operation unit 86, input operation unit 86 may be operated once again to thereby input an operation instruction to move shutter 71 from the first position to the second position. When the operation instruction to move shutter 71 from the second position to the first position is input into second input operation unit 87, shutter 71 may be moved automatically from the first position to the second position after a lapse of a prescribed time period since shutter 71 has been moved to the first position.

Also, in a configuration example, both input operation unit 86 and second input operation unit 87 may undergo a long press operation so as to cause shutter 71 to automatically move from the first position to the second position after a lapse of a prescribed time period since shutter 71 has been moved to the first position. In this case, the time period elapsed until shutter 71 automatically starts to move from the first position to the second position may be varied between: the case where the operation instruction to move shutter 71 from the second position to the first position is input into input operation unit 86; and the case where the operation instruction to move shutter 71 from the second position to the first position is input into second input operation unit 87. The setting for the time period elapsed until shutter 71 automatically moves from the first position to the second position may also be able to be selected by operating one of input operation unit 86 and second input operation unit 87.

Figure 9:
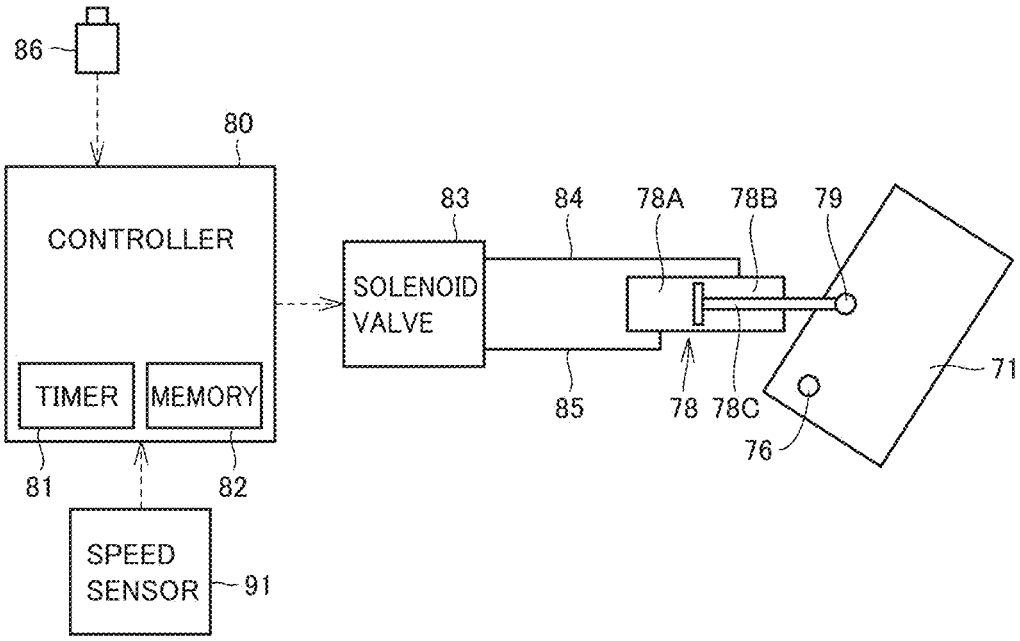
FIG. 9 is a diagram illustrating the second modification of the functional block of the work vehicle according to an embodiment.

FIG. 9 is a diagram illustrating the second modification of the functional block of work vehicle 100 according to an embodiment. The configuration shown in FIG. 9 is different from the configuration shown in FIG. 7 in that it further includes a speed sensor 91. Speed sensor 91 is configured to be capable of detecting the traveling speed of work vehicle 100.

In the case of the configuration including speed sensor 91, the traveling speed of work vehicle 100 detected by speed sensor 91 and the elapsed time period measured by timer 81 are multiplied, so that the traveling distance of work vehicle 100 can be calculated. Controller 80 is configured to be capable of controlling shutter 71 to be automatically moved from the first position to the second position after work vehicle 100 travels for a prescribed distance since shutter 71 has been moved to the first position. Speed sensor 91 has a function as a sensor to detect the distance in which work vehicle 100 travels after shutter 71 is moved to the second position.

Figure 10:
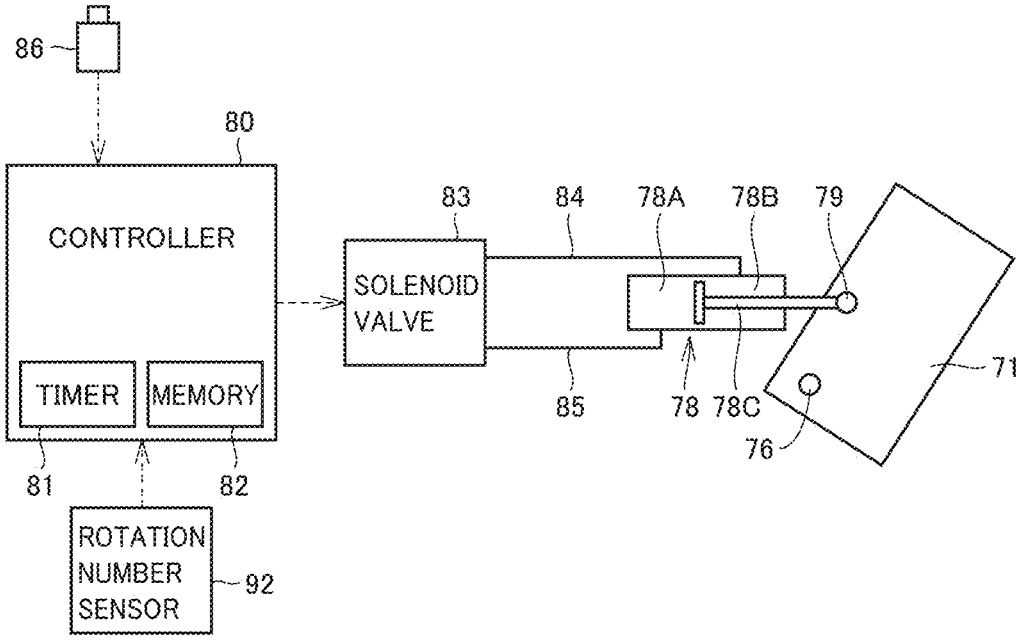
FIG. 10 is a diagram illustrating the third modification of the functional block of the work vehicle according to an embodiment.

FIG. 10 is a diagram illustrating the third modification of the functional block of work vehicle 100 according to an embodiment. The configuration shown in FIG. 10 is different from the configuration shown in FIG. 9 in that it includes, in place of speed sensor 91, a rotation number sensor 92 for detecting the rotation number of the driving wheel of work vehicle 100. Rotation number sensor 92 is configured to be capable of detecting the rotation number of one of six wheels including front wheels 11 and rear wheels 12.

For example, in the case of the configuration including rotation number sensor 92 for detecting the rotation number of rear wheel 12, the length of the outer circumference of rear wheel 12 (typically, the circumferential length of a circle) as seen in side view and the rotation number of this rear wheel are multiplied, so that the traveling distance of work vehicle 100 can be calculated. In this case, the elapsed time period does not have to be measured by timer 81 for calculating the traveling distance of work vehicle 100. Controller 80 is configured to be capable of controlling shutter 71 to be automatically moved from the first position to the second position after work vehicle 100 travels for a prescribed distance since shutter 71 has been moved to the first position. Rotation number sensor 92 has a function as a sensor to detect the distance in which work vehicle 100 travels after shutter 71 is moved to the second position.

Figure 11:
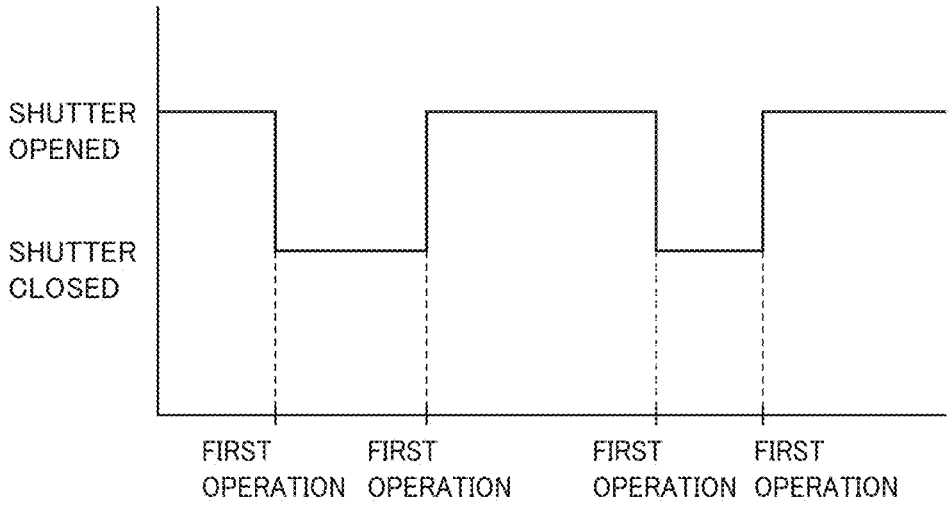
FIG. 11 is a timing chart in the case where the shutter is manually opened and closed.

FIG. 11 is a timing chart in the case where shutter 71 is manually opened and closed. "Shutter Opened" shown in FIG. 11 and also shown in FIGS. 12 and 13 described later indicates the state where shutter 71 is at the second position while "Shutter Closed" indicates the state where shutter 71 is at the first position.

As shown in FIG. 11, starting from the state where shutter 71 is opened, the first operation of input operation unit 86, for example, the short press operation of the push-button switch described above, is performed, thereby causing controller 80 to transmit a control signal to solenoid valve 83 to supply oil into bottom-side oil chamber 78A. Cylinder 78 having bottom-side oil chamber 78A supplied with oil is extended, thereby causing shutter 71 to be moved and brought into a closed state.

Starting from the state where shutter 71 is closed, the first operation of input operation unit 86 is performed once again, thereby causing controller 80 to transmit a control signal to solenoid valve 83 to supply oil into head-side oil chamber 78B. Cylinder 78 having head-side oil chamber 78B supplied with oil is contracted, thereby causing shutter 71 to be moved and brought into an opened state. In this way, shutter 71 can be manually opened and closed.

Figure 12:
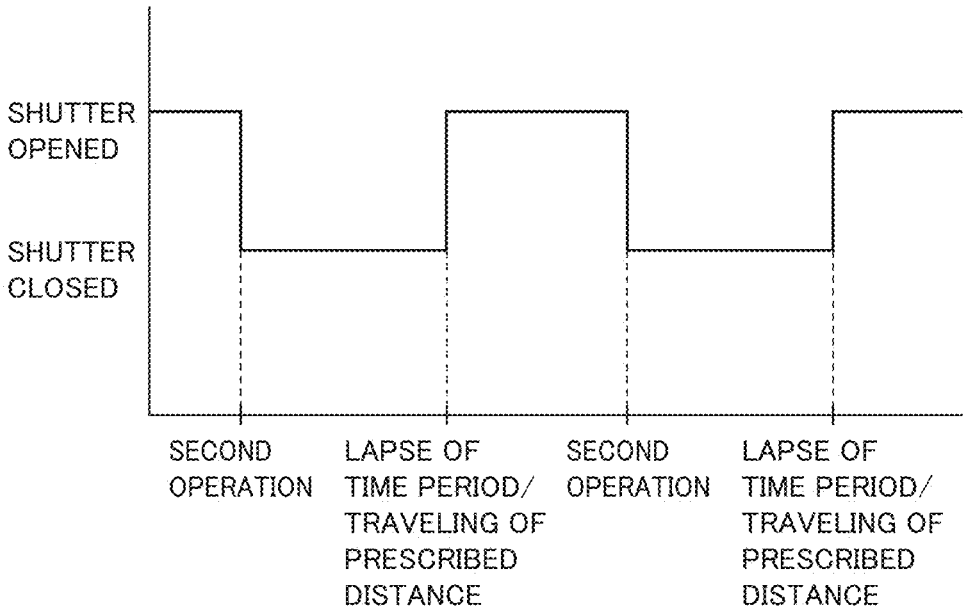
FIG. 12 is a timing chart in the case where the operation to open the shutter is automated.

FIG. 12 is a timing chart in the case where the opening operation of shutter 71 is automated. As shown in FIG. 12, starting from the state where shutter 71 is opened, the second operation of input operation unit 86, for example, the long press operation of the push-button switch describe above, is performed, thereby causing controller 80 to transmit a control signal to solenoid valve 83 to supply oil into bottom-side oil chamber 78A. Cylinder 78 having bottom-side oil chamber 78A supplied with oil is extended, thereby causing shutter 71 to be moved and brought into a closed state.

Then, even if input operation unit 86 is not operated, after a lapse of a prescribed time period, or after work vehicle 100 travels for a prescribed distance, controller 80 transmits a control signal to solenoid valve 83 to supply oil into head-side oil chamber 78B. Cylinder 78 having head-side oil chamber 78B supplied with oil is contracted, thereby causing shutter 71 to be moved and automatically brought into an opened state. In this way, the operation to open shutter 71 can be automated.

The prescribed time period or the prescribed distance for which shutter 71 is kept closed can be set, for example, as a time period or a distance required for work vehicle 100 to pass through an intersection. It is desirable that the operator aboard work vehicle 100 operates shutter 71 to be closed before work vehicle 100 enters an intersection, to thereby prevent formation of windrow WR while work vehicle 100 passes through the intersection, and then, after work vehicle 100 passes through the intersection, shutter 71 is automatically returned to the opened state. In consideration of the acceleration and deceleration of work vehicle 100 after it enters an intersection, more highly precise control can be achieved by controlling shutter 71 to be automatically opened after work vehicle 100 travels for a prescribed distance.

Figure 13:
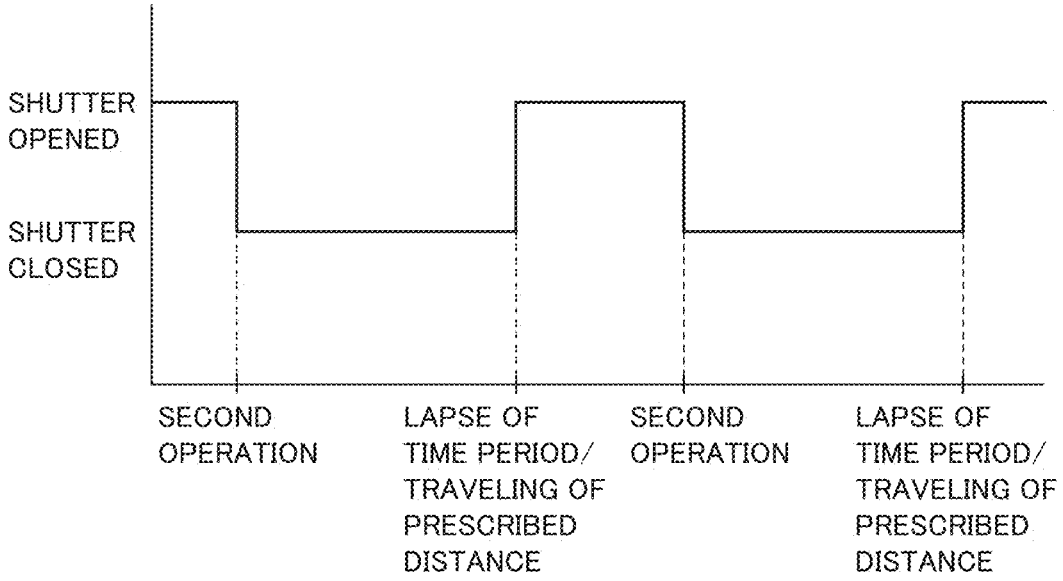
FIG. 13 is a timing chart of a modification in the case where the operation to open the shutter is automated.

FIG. 13 is a timing chart of a modification in the case where the operation to open shutter 71 is automated. In the case where the operation to open shutter 71 is automated, it is not always necessary to fix the setting for the prescribed time period or the setting for the traveling distance of work vehicle 100, which is measured from when shutter 71 is moved to the first position until when shutter 71 starts to move to the second position. In the modification shown in FIG. 13, the prescribed time period or the prescribed distance regarding traveling of work vehicle 100 is set to be longer than that in FIG. 12. In an embodiment, it may be possible to select a plurality of settings for the prescribed time period or a plurality of settings for the traveling distance of work vehicle 100, which is measured from when shutter 71 is moved to the first position until when shutter 71 starts to move to the second position.

In the case where a plurality of input operation units as described with reference to FIG. 8 are provided, the setting for the prescribed time period or the setting for the traveling distance of work vehicle 100 as described above may be selected according to, among a plurality of input operation units, an input operation unit to which an operation instruction is actually input. In an alternative configuration, the setting for the prescribed time period or the setting for the prescribed traveling distance of work vehicle 100 may be selected by an operator operating a switch or a touch panel in advance.

The following will be a summarized explanation about the characteristic configuration and functions and effects of work vehicle 100 according to the above-described embodiment. The configurations in the embodiment are designated by reference numerals, which are however given by way of example.

Work vehicle 100 according to the embodiment includes an input operation unit 86 and a controller 80 as shown in FIG. 7. As shown in FIG. 12, controller 80 receives an input of an operation instruction from input operation unit 86 to move shutter 71 from the second position ("shutter opened" position) to the first position ("shutter closed" position), to thereby cause shutter 71 to move from the second position to the first position. After a lapse of a prescribed time period since shutter 71 has been moved to the first position, controller 80 causes shutter 71 to move from the first position to the second position. Alternatively, after work vehicle 100 travels for a prescribed distance since shutter 71 has been moved to the first position, controller 80 causes shutter 71 to move from the first position to the second position.

The opening operation to move shutter 71 from the first position to the second position is automated based on the lapse of the time period or the traveling distance of work vehicle 100. The operator does not necessarily have to operate input operation unit 86 for performing the operation to open shutter 71. Since the operation of the operator to operate shutter 71 can be partially omitted, the operation to open and close shutter 71 can be simplified, so that the load upon the operator can be mitigated. Shutter 71 is controlled such that the operation to close shutter 71 is manually performed, which triggers only the shutter opening operation to be automatically performed. Thus, such control can be simplified and the operation to open the shutter can be automated in a simple configuration.

Furthermore, as shown in FIG. 11, controller 80 is configured to be capable of receiving an operation instruction from the input operation unit to move shutter 71 from the first position to the second position, to thereby cause shutter 71 to move from the first position to the second position. In this way, it becomes possible to select whether the operation to open shutter 71 is performed automatically or manually. When it is desired to reduce the load exerted upon an operator for operating shutter 71, shutter 71 can be automatically opened. Alternatively, when it is desired to more accurately adjust the position at which shutter 71 is opened during traveling of work vehicle 100, shutter 71 can be manually opened.

Also, as shown in FIGS. 11 and 12, input operation unit 86 is provided as a push-button switch and configured to be capable of undergoing a short press operation and a long press operation. When input operation unit 86 undergoes a short press operation, controller 80 receives an input of a further operation instruction from input operation unit 86 to cause shutter 71 to move from the first position to the second position. When input operation unit 86 undergoes a long press operation, controller 80 causes shutter 71 to automatically move from the first position to the second position. In this way, the operation to automatically open shutter 71 and the operation to manually open shutter 71 can be selectively switched in a simple configuration in which one push-button switch is provided. Furthermore, the operation related to selection between the operation to automatically open shutter 71 and the operation to manually open shutter 71 can be simplified.

Also as shown in FIGS. 12 and 13, it becomes possible to select a plurality of settings for a prescribed time period or a plurality of settings for a prescribed traveling distance of work vehicle 100, which are measured from when shutter 71 has been moved to the first position until when shutter 71 starts to move to the second position. In this way, shutter 71 can be automatically opened by appropriately setting the prescribed time period or the prescribed distance in accordance with the number of lanes on the road that work vehicle 100 intersects.

In the embodiments as described above, a motor grader has been described as an example of work vehicle 100, but work vehicle 100 is not limited to a motor grader. For example, work vehicle 100 may be a snow removal truck equipped with a plough or a blade.

The snow removal work performed by work vehicle 100 has been described in each embodiment, but the concept of each embodiment may be applied when work vehicle 100 performs a land grading operation for leveling the road surface.

Although work vehicle 100 includes operator's cab 3 in each embodiment, work vehicle 100 does not necessarily have to include operator's cab 3. Work vehicle 100 is not limited to the configuration in which an operator aboard work vehicle 100 operates work vehicle 100, but may be a configuration in which work vehicle 100 is operated by remote control from outside. In this case, since work vehicle 100 does not require operator's cab 3 for an operator to get aboard, work vehicle 100 does not have to include operator's cab 3.

Although the embodiments of the present invention have been described as above, it should be understood that the embodiments disclosed herein are illustrative and non-restrictive in every respect. The scope of the present invention is defined by the terms of the claims, and is intended to include any modifications within the meaning and scope equivalent to the terms of the claims.

What is claimed is:

1. A work vehicle comprising:

a blade including a lower end;

a shutter attached to the blade, the shutter being capable of being disposed alternatively at a first position at which the shutter protrudes forward from the lower end of the blade and at a second position at which the shutter is farther away from the lower end of the blade than at the first position;

an actuator configured to cause the shutter to move from one to the other between the first position and the second position;

an input operation unit for manually inputting an operation instruction by an operator to the actuator; and a controller including a timer for measuring time, the controller being configured to:

receive an input of the manual operation instruction from the input operation unit to move the shutter from the second position to the first position, to cause the shutter to move from the second position to the first position, and after the controller receives an input from the timer indicating a lapse of a prescribed time period with a point of time when the controller receives the input of the operation instruction as a starting-point for the time detection cause the shutter to move from the first position to the second.

2. The work vehicle according to claim 1, wherein the controller is configured to be capable of receiving an input of the operation instruction from the input operation unit to move the shutter from the first position to the second position, to cause the shutter to move from the first position to the second position.

3. The work vehicle according to claim 2, wherein the input operation unit is configured to be capable of accepting alternatively one of a first operation and a second operation different from the first operation, each for moving the shutter from the second position to the first position, and the controller is configured to cause the shutter to move from the first position to the second position in response to reception of an input of the operation instruction from the input operation unit when the first operation is performed, and cause the shutter to automatically move from the first position to the second position when the second operation is performed.

4. The work vehicle according to claim 3, wherein the input operation unit includes a push-button switch, and the first operation is a short press operation of the push-button switch, and the second operation is a long press operation of the push-button switch.

5. The work vehicle according to claim 1, wherein a plurality of settings for the prescribed time period are selectable.

6. The work vehicle according to claim 1, wherein at the first position the shutter protrudes forward beyond a leading edge of the lower end of the blade.

7. A work vehicle comprising:

a blade including a lower end;

a shutter attached to the blade, the shutter being capable of being disposed alternatively at a first position at which the shutter protrudes forward from the lower end of the blade and at a second position at which the shutter is farther away from the lower end of the blade than at the first position;

an actuator configured to cause the shutter to move from one to the other between the first position and the second position;

an input operation unit for manually inputting an operation instruction by an operator to the actuator;

a sensor configured to detect a traveling distance of the work vehicle after the shutter is moved to the first position; and a controller, the controller being configured to:

receive an input of the manual operation instruction from the input operation unit to move the shutter from the second position to the first position, to cause the shutter to move from the second position to the first position, and after the controller receives an input from the sensor indicating that the work vehicle travels for a prescribed distance with a location of the work vehicle when the controller receives the input of the operation instruction as a starting-point for the distance detection cause the shutter to move from the first position to the second position.

8. The work vehicle according to claim 7, wherein the controller is configured to be capable of receiving an input of the operation instruction from the input operation unit to move the shutter from the first position to the second position, to cause the shutter to move from the first position to the second position.

9. The work vehicle according to claim 8, wherein the input operation unit is configured to be capable of accepting alternatively one of a first operation and a second operation different from the first operation, each for moving the shutter from the second position to the first position, and the controller is configured to cause the shutter to move from the first position to the second position in response to reception of an input of the operation instruction from the input operation unit when the first operation is performed, and cause the shutter to automatically move from the first position to the second position when the second operation is performed.

10. The work vehicle according to claim 9, wherein the input operation unit includes a push-button switch, and the first operation is a short press operation of the push-button switch, and the second operation is a long press operation of the push-button switch.

11. The work vehicle according to claim 7, wherein a plurality of settings for the prescribed distance are selectable.

12. The work vehicle according to claim 7, wherein at the first position the shutter protrudes forward beyond a leading edge of the lower end of the blade.

* * * * *